US006713942B2

(12) United States Patent
Raman et al.

(10) Patent No.: US 6,713,942 B2
(45) Date of Patent: Mar. 30, 2004

(54) PIEZOELECTRIC DEVICE WITH FEEDBACK SENSOR

(75) Inventors: Arvind Raman, Lafayette, IN (US); Suresh V. Garimella, Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 114 days.

(21) Appl. No.: 09/863,832

(22) Filed: May 23, 2001

(65) Prior Publication Data

US 2002/0175597 A1 Nov. 28, 2002

(51) Int. Cl.[7] ..... H01L 41/09; H02N 2/06

(52) U.S. Cl. ..... 310/316.01; 310/324; 310/330; 310/333; 310/311

(58) Field of Search ..... 310/316.01

(56) References Cited

U.S. PATENT DOCUMENTS 4,413,198 A * 11/1983 Bost ..... 310/322
4,536,674 A * 8/1985 Schmidt ..... 310/330
4,595,338 A * 6/1986 Kolm et al. ..... 310/330
4,780,062 A 10/1988 Yamada et al. ..... 417/322
5,008,582 A * 4/1991 Tanuma et al. ..... 310/324
5,184,332 A * 2/1993 Butler ..... 181/160
5,251,264 A * 10/1993 Tichy ..... 381/114
5,371,428 A * 12/1994 Kikuchi et al. ..... 310/322
5,514,927 A * 5/1996 Tichy ..... 310/322
5,761,324 A * 6/1998 Kanai et al. ..... 381/173
5,784,340 A * 7/1998 Kanai ..... 310/322
5,798,600 A 8/1998 Sager et al. ..... 310/330
5,856,956 A * 1/1999 Toki ..... 310/324
5,861,703 A 1/1999 Losinski ..... 310/330
5,866,433 A 2/1999 Schalkhammer et al. ... 436/525
5,889,873 A * 3/1999 Sasaki ..... 310/324
5,921,757 A 7/1999 Tsutsui et al. ..... 417/410.2
5,955,821 A * 9/1999 Yamamoto et al. ..... 310/321

* cited by examiner

*Primary Examiner*—Tran Nguyen
*Assistant Examiner*—J. Aguirrechea

(57) ABSTRACT

A piezoelectric device, such as a piezoelectric fan or micro-jet generator, for moving a fluid comprising a fluid-moving member having a first piezoelectric (PZT) actuator element coupled thereto to drive or actuate the movable member and a second piezoelectric (PZT) sensing element coupled thereto to provide feedback information related to fluid parameter. The second PZT element also can be used to drive the movable member in conjunction with the first PZT element. The feedback information can be used by a controller to control operation of the piezoelectric device.

18 Claims, 1 Drawing Sheet

PIEZOELECTRIC DEVICE WITH FEEDBACK SENSOR

FIELD OF THE INVENTION

Figure 1:
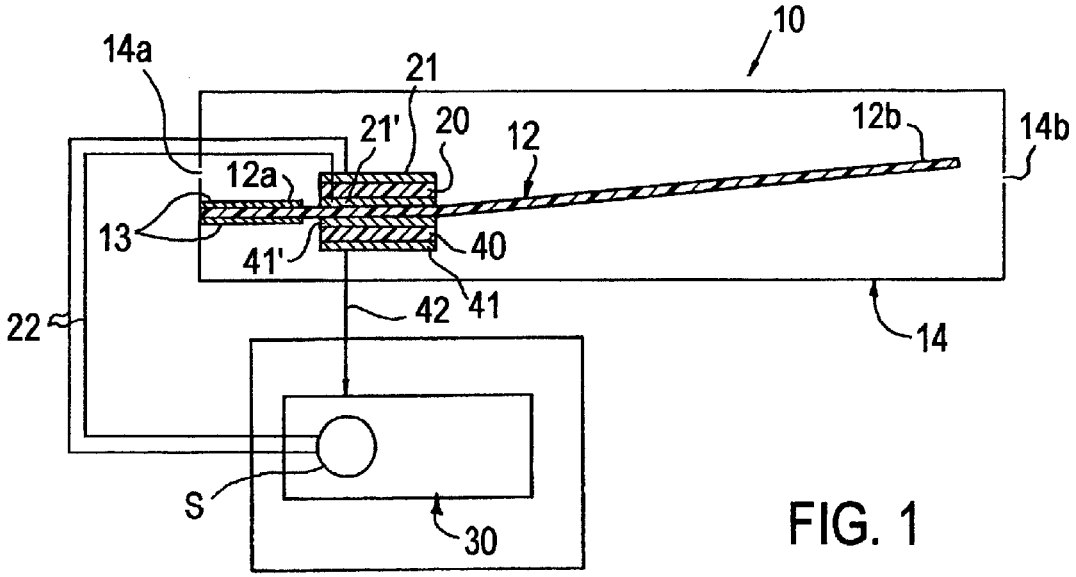

The invention relates to a piezoelectric device for moving a fluid and having information feedback capability.

BACKGROUND OF THE INVENTION

The use of fans for establishing a cooling air circulation in a housing of a portable electronic device is well known in the art. Typically, such fans have comprised piezoelectric fans or rotary type fans. For example, U.S. Pat. No. 5,861,703 describes an axial flow piezoelectric fan wherein a single fan blade is disposed in a housing having an axial flow passage with an inlet an outlet for cooling air. The fan blade carries a piezoelectric element that is electrically actuated to cause the fan blade to vibrate in the housing in a manner that cooling air is drawn in the inlet, flows axially through the air flow passage generally parallel to the housing wall and blade, and is discharged as an axially-flowing air stream from the outlet.

An object of the present invention is to provide a piezoelectric device amd method having information feedback capability that may be used to control operation of the device.

SUMMARY OF THE INVENTION

The present invention provides a piezoelectric device, such as a piezoelectric fan, pump, or microjet generator, and method for moving a fluid comprising a movable member having a first piezoelectric (PZT) actuator element coupled thereto to drive or actuate the movable member to move the fluid and a second piezoelectric (PZT) sensing element coupled thereto to provide feedback information (signals) related to a fluid parameter such as, for example, fluid viscosity, fluid density and/or fluid temperature. The second PZT element also can be used to drive the movable member in conjunction with the first PZT element. The feedback information can be used by a controller to control operation of the piezoelectric device.

Advantages and objects of the invention will become more readily apparent from the following description.

DESCRIPTION OF THE INVENTION

FIG. 1 is a schematic view of a piezoelectric fan device having a PZT actuator element and PZT sensing element pursuant to an embodiment of the invention.

DESCRIPTION OF THE INVENTION

For purposes of illustration and not limitation, FIG. 1 illustrates schematically a low power, light-weight, thin profile piezoelectric fan 10 having a movable member 12 such as a flexible blade, plate or diaphragm fixed at one end 12*a* by clamp plates 13 on a housing 14 and free at the other end 12*b* to move up and down in the housing in FIG. 1 in a bending vibration mode near or at a fundamental resonance of the movable member 12. The housing 14 includes an inlet aperture 14*a* for fluid such as air and an outlet aperture 14*b* through which fluid is ejected; e.g. a cooling air stream is ejected through aperture 14*b*. Piezoelectric fans are known in the art and described in U.S. Pat. Nos. 4,780,062; 5,861,703; and 5,921,757 for example, the teachings of which are incorporated herein by reference. The invention is not limited to any particular piezoelectric fan and can practiced with piezoelectric fans of various types, pumps, microjet generating devices described in copending application entitled "THIN PROFILE PIEZOELECTRIC JET DEVICE" of common inventorship herewith (attorney docket number PU62), the teachings of which are incorporated herein by reference, and other piezoelectric devices operable to move a fluid. Piezoelectric fans and pumps are commonly employed to generate a moving air flow for use in cooling portable electronic devices, such as cell phones, laptop computers, personal digital assistance devices and the like.

A first piezoelectric (PZT) actuator element 20 is coupled to (e.g. bonded on) the movable member 12 to drive or actuate the movable member in a bending vibration mode near or at its fundamental resonance to move fluid through the aperture 14*b*. The PZT element 20 is adhesively bonded on the top side of the movable member 12 and can comprise a conventional ceramic or polymer (e.g. polyvinylidene fluoride (PVDF)) PZT element having two metal (e.g. Ni, Ag, etc.) electrodes 21', 21 on opposite sides connected by lead wires 22 to an electronic microprocessor controller 30. The inner electrode 21' adjacent the movable member 12 is a grounded electrode.

The PZT element 20 is connected to electronic microprocessor controller 30 that provides periodic alternating voltage signals to the PZT element 20 at a frequency to drive the movable member 12 near or at resonance. The periodic alternating voltage signals cause the PZT element 20 to contract and expand periodically to drive the movable member 12 as is well known. The controller 30 can be a conventional phase locked loop type of controller including an electrical power source (drive circuit) S to drive PZT elements at resonance as determined by the particular periodic alternating voltage output signal provided by the source S to the PZT element 20.

Pursuant to an embodiment of the invention, a second piezoelectric (PZT) sensing element 40 is coupled to (e.g. bonded on) the opposite bottom side of the movable member 12, although the elements 20, 40 can be bonded on the same side of movable member 12 or their positions reversed from those shown. The PZT sensing element 40 is used to provide feedback information regarding at least one of fluid viscosity, fluid density, and fluid temperature to controller 30. To this end, the sensing element 40 includes two metal electrodes 41 on opposite sides. The inner electrode 41' adjacent the movable member 12 is a grounded electrode, while the outer electrode 41 is connected by a lead wire 42 to the controller 30. The second PZT element 40 also can be used to drive the movable member 12 in conjunction with the first PZT element 20 in accordance with alternating voltage signals supplied from the controller 30 to both PZT elements 20, 40. Although electrodes 21, 21'; 41, 41' are shown as overlying the entire sides of the elements 20, 40, those skilled in the art will appreciate that the electrode elements can be present as smaller areas or patches of any configuration on the sides of elements 20, 40.

The controller 30 includes a conventional phase locked loop circuit (not shown) to maintain at 90 degrees the phase difference between the signal emerging from the PZT element 40 and the signal input to the actuator PZT element 20. This insures that the controller 30 tracks the natural frequency of the movable member 12 as it changes with changing external conditions such as fluid temperature, viscosity and density. The movable member 12 thereby can be driven at resonance to achieve near maximum amplitude and fluid moving (e.g. air blowing) efficiency. Such phase locked loop circuits are commercially available.

The PZT sensing element 40 and its lead wire 42 are used to provide to controller 30 feedback information (signals) that can be correlated to changes in viscosity and/or density of the fluid being moved by the movable member 12. For example, for the same input force on movable member 12 from PZT actuator element 20, the damping of vibration of movable member 12 (and thus that of PZT sensing element 40) will depend on the viscosity of the surrounding fluid. This principle is commonly found in the design of vibratory viscometers. The amplitude of the signal at resonance (voltage amplitude signal) provided by PZT sensing element 40 can be calibrated to represent the viscosity of the fluid being moved at a given time. Alternately, or in addition, the bandwidth of the peak of the voltage signal provided by the PZT sensing element 40 can be calibrated to represent the viscosity of the fluid being moved at a given time. The bandwidth can be determined by comparing phase response of the signal just before and just after resonance as controlled by appropriately varying frequency of excitation of the movable member. The greater the damping by the fluid, the slower the phase angle of the voltage signal drops off away from resonance as is well known. The calibration data can be stored in controller memory as gain values (voltage bias values) and accessed by controller logic to make the determination of fluid viscosity at a given time by comparing the signal received from the sensing element 40 at a given time with the stored calibration data.

Furthermore, if the density of the fluid being moved changes the natural frequency of vibration of the movable member 12 (and thus that of PZT sensing element 40) changes due to the changed "added mass effect" attributable to the fluid density change. The controller 30 can track and determine the change in natural frequency of vibration (alternating voltage frequency signal) of the PZT sensing element 40 such that the change of the natural frequency can be calibrated to represent the density of the fluid being moved at any given time. The calibration data can be stored in controller memory as a gain values (voltage bias values) on the difference in signal frequencies provided by sensing element 40 and accessed by controller logic to make the determination of fluid density at a given time by comparing the signal received from the sensing element 40 with the stored calibration data.

The viscosity and/or density feedback information can be used by the controller 30 to control operation of the piezoelectric device 10. For example, either the fluid viscosity feedback or the fluid density feedback, or both, can be used by controller 30 to vary the output signal SIG delivered to PZT element 20 of the device 10 by controlled source (drive circuit) S.

Those skilled in the art will appreciate that either the viscosity feedback or the density feedback, or both, determined from signals provided by the single PZT sensing element 40 can be used by controller 30 at a given time of operation of the piezoelectric device 10 to this end. Alternately, a pair of PZT sensing elements 40 can be provided on movable member 12 with one providing viscosity feedback and the other providing density feedback to the controller 30.

If viscosity and/or density feedback information is to be provided to the controller 30, the PZT sensing element(s) 40 typically are made of the same PZT material as PZT actuator sensor 20. If the PZT sensing element 40 also is used to drive the movable member 12, it will have a polarity opposite to that of PZT actuator element 20.

In another embodiment of the invention, the PZT sensing element 40 and its lead wire 42 are used to provide to controller 30 feedback information that can be correlated to changes in the temperature of the fluid being moved by the movable member 12. In this embodiment, the PZT sensing element 40 will comprise a PZT material having a different thermal expansion coefficient from that of the PZT actuator element 20. For example, the PZT actuator element 20 can comprise a conventional ceramic PZT material, while the PZT sensing element 40 can comprise a polymer PZT material of the type described above.

As the temperature of the fluid changes (increases or decreases) from ambient, the difference in thermal expansion coefficient between PZT elements 20 and 40 will impart a bend to the movable member 12 and generate a positive or negative DC analog voltage signal from the PZT sensing element 40 depending upon whether fluid temperature decreases or increases. This DC analog voltage signal can be calibrated to fluid temperature, and the calibration data can be stored in controller memory as bias voltage values and accessed by controller logic to make the determination of fluid temperature at a given time by comparing the signal received from the sensing element 40 with the stored calibration data.

If the fluid temperature rises beyond a certain threshold value, the voltage from PZT sensing element 40 will rise above a voltage threshold value, and the controller 30 will actuate the piezoelectric fan 10 using the phase locked loop control to provide a cooling air flow. The controller 30 can be programmed to stop fan operation automatically after a period of time to sense the fluid temperature again. If the fluid temperature is not sufficiently reduced (below the threshold value), the control logic requires the fan 10 to continue operating. On the other hand, if the temperature of the fluid has cooled below the threshold value, the control logic stops the fan 10 from operating.

Those skilled in the art will appreciate that the temperature feedback mode can be provided alone or in conjunction with the viscosity feedback mode and/or the density feedback mode of operation. Temperature feedback will be provided by a PZT temperature sensing element on the movable member 12 and viscosity/density feedback will be provided by one or more different PZT viscosity/density sensing element(s) on the movable member 12.

Use of the PZT sensing element(s) 40 for fluid viscosity, fluid density, and/or fluid temperature pursuant to the invention can substantially increase the performance and reduce the power consumption of the piezoelectric fans, pumps, and microjet generators.

Although the invention has been described with respect to certain embodiments thereof, those skilled in the art will appreciate that modifications, additions, and the like can be made thereto within the scope of the invention as set forth in the following claims.

We claim:

1. A device for moving a fluid, comprising a movable member having a first piezoelectric actuator element coupled thereto to drive said movable member to move said fluid and a second piezoelectric sensing element coupled thereto to provide feedback signals to a controller that determines from said feedback signals at least one of viscosity, density, and temperature of said fluid and controls said first piezoelectric actuator element in response to at least one of the determined viscosity density and temperature of said fluid.

2. The device of claim 1 wherein said second piezoelectric sensing element provides feedback signals related to fluid viscosity.

3. The device of claim 1 wherein said second piezoelectric sensing element provides feedback signals related to fluid density.

4. The device of claim 1 wherein said second piezoelectric sensing element provides feedback signals related to fluid temperature.

5. The device of claim 4 wherein said second piezoelectric sensing element has a thermal expansion coefficient different from that of said first piezoelectric actuator element.

6. The device of claim 1 wherein said movable member is a flexible member.

7. The device of claim 1 wherein said movable member is a flexible blade.

8. The device of claim 1 including a power source controlled by said controller to provide a power output signal in response to at least one of the determined viscosity, density, and temperature of said fluid.

9. The device of claim 1 wherein said controller has calibration data stored in memory and compares said feedback signals to said calibration data to determine at least one of the viscosity, density, and temperature of said fluid.

10. A method of operating a piezoelectric device for moving a fluid, comprising moving a movable member using a first piezoelectric actuator element on said movable member, and providing feedback signals from a second piezoelectric element on said movable member to a controller, including said controller determining from said feedback signals at least one of viscosity, density, and temperature of said fluid and controlling said first piezoelectric actuator element in response to at least one of the determined viscosity, density, and temperature of said fluid.

11. The method of claim 10 wherein said second piezoelectric sensing element provides feedback signals related to fluid viscosity.

12. The method of claim 10 wherein said second piezoelectric sensing element provides feedback signals related to fluid density.

13. The device of claim 10 wherein said second piezoelectric sensing element provides feedback signals related to fluid temperature.

14. The method of claim 13 including providing said second piezoelectric sensing element with a thermal expansion coefficient different from that of said first piezoelectric actuator element.

15. The method of claim 10 including storing calibration data relating said feedback signals to at least one of viscosity, density, and temperature of said fluid in memory of said controller and comparing said feedback signals to the calibration data to determine at least one of the viscosity, density, and temperature of said fluid.

16. A device for moving a fluid, comprising a movable member having a first piezoelectric actuator element coupled thereto to drive said movable member to move said fluid and a second piezoelectric sensing element coupled thereto and having a thermal expansion coefficient different from that of said first piezoelectric actuator element to provide temperature dependent feedback signals to a controller that determines from said feedback signals a temperature of said fluid, said controller controlling said first piezoelectric actuator element in response to the determined temperature of said fluid.

17. The device of claim 16 wherein the controller controls said first piezoelectric element to actuate said movable member to provide air flow when the fluid temperature increases above a threshold value.

18. The device of claim 16 wherein the controller controls said first piezoelectric element to terminate air flow by said movable member when fluid temperature decreases below a threshold value.

* * * * *

UNITED STATES PATENT AND TRADEMARK OFFICE

CERTIFICATE OF CORRECTION

PATENT NO. : 6,713,942 B2
DATED : March 30, 2004
INVENTOR(S) : Raman et al.

It is certified that error appears in the above-identified patent and that said Letters Patent is hereby corrected as shown below:

Title page,
Item [75], Inventors, replace with the following:
-- Arvind Raman, Lafayette, IN (US); Suresh V. Garimella, West Lafayette, IN (US) --.

Column 4,
Line 63, after "viscosity" insert -- . --.
Line 63, after "density" insert -- . --.

Signed and Sealed this

Thirtieth Day of November, 2004

JON W. DUDAS
*Director of the United States Patent and Trademark Office*